United States Patent [19]

Batchelor

[11] 4,083,468

[45] Apr. 11, 1978

[54] VACUUMIZING CLOSURE FOR VACUUM PACK CONTAINERS

[76] Inventor: John Howard Batchelor, 1467 Robin La., El Cajon, Calif. 92020

[21] Appl. No.: 798,794

[22] Filed: May 20, 1977

[51] Int. Cl.[2] ..... B65D 53/00

[52] U.S. Cl. ..... 220/234; 220/238; 220/256; 220/307

[58] Field of Search ..... 220/234, 200, 238, 256, 220/307, 367; 206/315 B, 524.8

[56] References Cited

U.S. PATENT DOCUMENTS

| | | | |
|---|---|---|---|
| 3,087,641 | 4/1963 | Millard | 220/238 |
| 3,756,480 | 9/1973 | Swett et al. | 220/234 X |

*Primary Examiner*—George T. Hall

*Attorney, Agent, or Firm*—William H. Maxwell

[57] ABSTRACT

A reclosure device for vacuum pack containers and the like, comprised of a diaphragm that seals with the opened end of the container and actuating means therefor to position it axially outward from an initially inward extension into the container, thereby drawing a partial vacuum upon the contents within the said container.

21 Claims, 4 Drawing Figures

VACUUMIZING CLOSURE FOR VACUUM PACK CONTAINERS

BACKGROUND

Food stuffs such as coffee, nuts, fruits and jams etc. are vacuum packed in order to maintain freshness for delivery to the consumer. Obviously however, the products begin to loose freshness the moment the container is opened and the vacuum lost to the surrounding atmosphere which is normally humid to a substantial degree. Therefore, hermetic closures have been attempted but even then the capture of air at atmospheric pressure subjects the product to the permeation of dampness. On the contrary, the reestablishment of a partial vacuum would impose the depressurization known to be so beneficial in maintaining freshness, and to this end it is a general object of this invention to provide a closure that draws a vacuum upon a container to preserve the freshness of the product previously vacuum packed therein. With the present invention, installation of the Vacuumizing Closure substantially reduces atmospheric pressure within the container so as to draw moisture from the product stored therein, thereby eliminating the otherwise expected gradual but continuous permeation of moisture leading to staleness of the product.

The application to containers of the usual stoppers, plug-in and screw-in closures, tends to compress the interior rather than to depress the same, and thereby impresses the atmospheric humidity upon the product remaining therein. The greater the volume of remaining product the greater is the compressive and/or depressive effect, due to the smaller remaining container space to be filled by said atmosphere. However, the lesser the volume of remaining product the greater is the remaining container space inherently filled with atmospheric humidity to have its adverse effect upon the product. Accordingly, it is an object of this invention to provide a closure that initially occupies the chamber together with the product therein, to draw atmospheric humidity therefrom.

Containers for food stuffs are not filled to their brim, but are filled to a level which constitutes a measured portion either by weight or by volume. In any case, the fill level is below the container rim, and it is from this level that a portion of the product will be taken at the first opening of said container. For example, when brewing coffee the product level will be approximately an inch below the container rim after withdrawing sufficient coffee to brew a large pot thereof; and it is this measurement which determines the depth to which the present closure penetrates and which determines the draw of partial vacuum thereby. It is an object therefore, to maximize the closure occupancy to thereby maximize the drawing of a partial vacuum. With this invention, the closure enters into the container to the level of product therein, preferably after a normal portion thereof has been removed, thereby maximizing the vacuum effect.

The resealing of containers such as metal cans is a problem once the hermetic seal of the integral lid is broken, as for example by complete removal of said lid. With the usual beaded can construction, the rolled and/or crimped bead of the can is left to present a circumferential rim of smooth uniform cross section, distorted to some extent perhaps by slight imperfection in manufacture and by bending during the can opening process.

Accordingly, it is an object of this invention to reestablish a hermetic seal with the bead left remaining at the circumferential rim of the can, to seal with the inner and outer diameters of the bead.

It is a general object of this invention to provide a Vacuumizing Closure of the character hereinabove referred to that is simple and economical of manufacture, and a device that is inherently practical for the purpose intended of drawing a partial vacuum upon the remaining content of a glass or jar or can and any such vessel that has been opened and/or which requires closure, so as to establish a hermetic seal with the bead at the otherwise opened end thereof, a feature of the invention being the simplicity of application and removal which requires but a single movement of an actuating lever in each instance.

SUMMARY OF INVENTION

This invention relates particularly to the revacuumizing of containers in which edibles or food stuffs have been vacuum packed, and especially beaded metal cans characterized by a peripheral bead that attaches the end of the can which is removed by opener means that severs the end contiguous to the inner diameter wall of the cylindrical can body. To this end I provide a cover A that carries an axially extended diaphragm B, and an actuator means C that shifts the diaphragm between extended and withdrawn positions. A feature of this invention is the hermetic engagement of the diaphragm B with the bead of the container, by means of a seal S that tightly embraces the perimeter bead of the container. Operation of the actuator means C shifts the diaphragm B toward the cover A, thereby drawing a partial vacuum within the container while pulling the seal S tightly into engagement with the container bead. The device is removable by means of a reverse operation of the actuator C shifting the diaphragm B away from the cover A.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
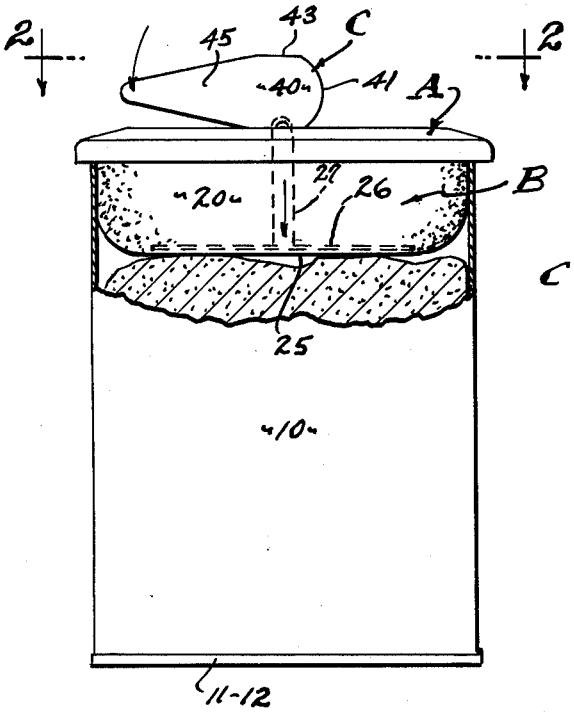
FIG. 1 is a side elevation of a container with the vacuumizing closure applied thereto, a portion of the container being broken away to show the content and closure relationship prior to vacuumizing.
Figure 2:
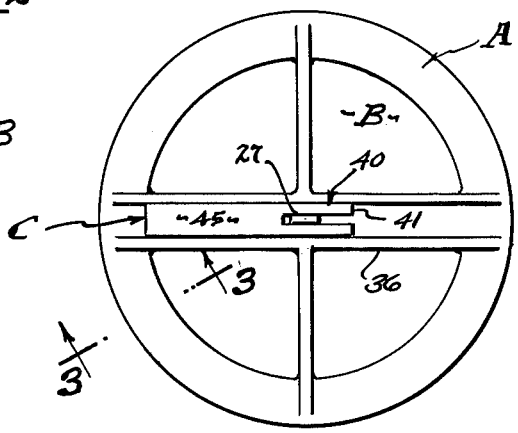
FIG. 2 is a plan view taken as indicated by line 2—2 on FIG. 1.

The usual vacuum pack container is a so-called "tin can" comprised of a cylindrical body 10 and opposed disc-shaped ends 11 secured to the body by rolled or crimped beads 12. Access or entry into such a container is by means of removing one of said ends 11, leaving an open perimeter defined by the bead 12 from which the end disc has been removed. Although this particular can container is the present standard, its disclosure herein does not preclude the use of other containers of other materials such as glass and/or plastic which present open ends defined by features of the same general configuration as the said bead 12 which presents inner and outer diameter walls 14 and 15 joined by a rim 13 disposed in a plane normal to the container axis. In practice, the rim 13 is convex in cross section as it is developed from a continuous circumferential flange of material folded outwardly and downwardly and then inwardly so as to lock the end closure to the can body, in the form of said bead 12 as shown. A feature is the uninterrupted nature of the said bead 12, that is with no circumferential interruption.

Referring now to the Vacuumizing Closure of the present invention, the cover A is a rigid member that carries the flexible diaphragm B and the actuator means C therefor, the seal S being incorporated in the periphery of the said diaphragm. Accordingly, the cover A and parts of the means C are made of rigid polystyrene plastic or the like, while the diaphragm B with its seal S is made of a more supple material such as an elastomer or plastic such as polypropylene or the like. As shown, parts of the actuator means C can be made of metal, however it is to be understood that both the cover A and actuator means C can be made of either metal or plastic as may be desired.

The diaphragm B is comprised of an axially extended peripheral bellows 20 depending from the seal S to a piston wall 25 occupying the greater central area of the container interior. For example, the piston wall 25 is approximately or more than three quarters the area of the cylinder body 10. In carrying out this invention, the diaphragm B and seal S are integrally formed of a rubber-like elastomeric material or plastic material such as polypropylene, to extend from the seal S and throughout the bellows 20 and piston wall 25 so as to present an imperforate member having flexibility that permits axial shifting of said piston wall 25. The properties of said elastomer or plastic material provides for flexibility required of the seal and bellows respectively, and the piston wall 25 is made rigid by a piston plate 26 as part of the actuator means C.

Figure 3:
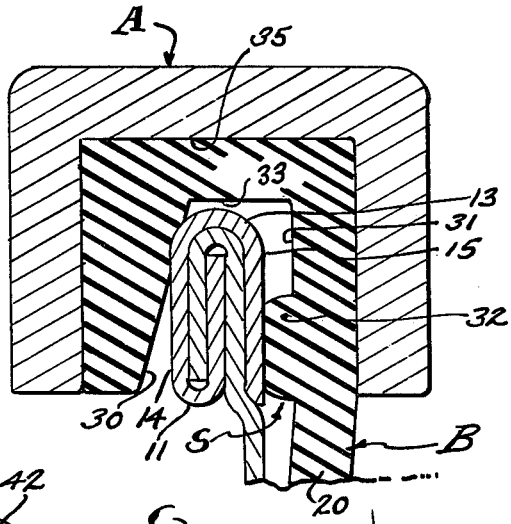
FIG. 3 is an enlarged detailed fragmentary view taken as indicated by line 3—3 on FIG. 2.

Referring now to the seal S, the perimeter of the diaphragm B is characterized by a downwardly open channel to slip over and embraceably receive the bead 12 of the container. The said channel is annular and comprised of upwardly convergent inner and outer diameter walls 30 and 31 spaced to openly receive the bead 12 and converging to have an interference fit therewith. The walls 30 and 31 are of a depth commensurate to the depth of the inner and outer diameter walls 13 and 14 of the container bead 12, and as best shown in FIG. 3 there is at least one continuously circumferential lip 32 at the inner diameter wall 30 to project outwardly against the inner diameter wall 14 of the bead. In the preferred configuration, the inner diameter wall 30 is of right cylinder form with the seal lip 32 protruding radially therefrom to partially occupy the channel opening, while the outer diameter wall 31 is conically divergent from the inner diameter wall and seal lip. As shown, the walls 30 and 31 are joined by a planar bottom wall 33 disposed parallel to rim 13 so as to remain spaced therefrom (as shown) or to stop thereagainst. Since the positive atmospheric pressure is from the exterior, the seal lip 32 is restrained by the cover A, as will be described, to bear outwardly into pressured engagement with said inner diameter wall 14 of the container bead. In its preferred form, the seal lip 32 is a rib or protrusion of semi-circular cross section extending into the channel opening of the seal, establishing the outer peripheral equivalent of an O-ring seal biased into tight interference engagement with wall 15 so that differential pressure caused by a partial vacuum within the container is effectively checked. It will be apparent how the seal channel and lip 32 jambs onto the bead 12 of the container for tight hermetic engagement.

Figure 4:
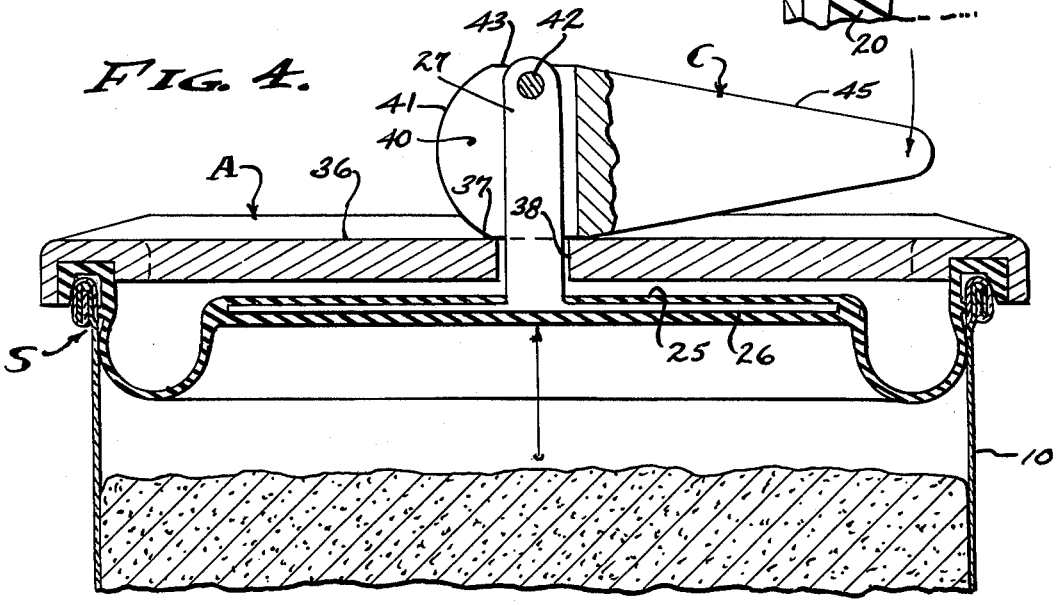
FIG. 4 is an enlarged detailed sectional view, similar to the upper portion of FIG. 1, showing the content and closure relationship after vacuumizing.

Referring now to the diaphragm B, the bellows 20 thereof is a flexible membrane of a thickness thereby sufficiently pliable or bendable and with a memory to shift from the extended position shown in FIG. 1 to the retracted position shown in FIG. 4. The piston wall 25 thereof encapsulates the piston plate 26 with a piston rod 27 projecting axially upward therefrom, integral with the bellows 20 and seal S. The bellows 20 is of concavo-convex form extending axially downward from the perimeter seal S and inwardly to be tangent with the piston wall and plate 25–26. Accordingly, the said piston wall and plate are initially offset a substantial distance downward from the plane of the open container end defined by its bead 12.

Referring now to the cover A, the perimeter thereof is characterized by a configuration overlying the seal S to accommodate the same. As shown, the perimeter of the cover coextensively overlies the seal S, as by means of a downwardly open groove 35 that locates and backs up the seal S and which applies downward pressure thereto when the actuator means C is operated. The walls 30, 31 and 33 comprise the annular body of the seal S that is restrictively accommodated in the groove 35, to be backed up both radially and axially. The axial back-up is for the downward application of pressure to the seal, while the radial back-up is for the outward bias of the lip 32 thereof. Diametrically of the groove 35 there is a spreader 36 having a central bearing 37 and opening 38 to pass the piston rod 27. In practice, the spreader is such as to vent the cover therein and is a beam or the like as shown.

Referring now to the actuator means C, the piston wall 25 is positioned by the piston plate 26 to assume the alternate positions shown in FIGS. 1 and 4. The memory of the diaphragm B establishes the initial extended position of FIG. 1, while withdrawal as by means of a pull rod or "T" handle (not shown) establishes the operated position of FIG. 4. Preferably, there is a lift cam 40 revolved by a manually operable lever 45. In carrying out this invention, a high lift cam is employed that operates through an arc of 180° to shift the piston plate 26 from its extended position to its retracted position. To this end the cam comprises a semi-circular face 41 slideably engageable with the bearing 37 and pivoted eccentrically by a pin 42 on a transverse axis to the rod 27. Diametrically opposite the eccentric offset of pin 42 there is a flat 43 that has releasably positioned engagement with the bearing 37. The lever 45 is integral with the cam 40 and extends in alternately radial directions between opposite perimeters of the cover A from which it is manually engageable to be lifted and shifted for its operation in alternately positioning the rod 27 to extend or retract as shown.

From the foregoing it will be seen that this Vacuumizing Closure seals with the bead of an opened can or jar and is operable through one single operation to draw a partial vacuum upon the interior of the chamber closed thereby and any content left remaining therein. In practice, the seal S of the diaphragm B is jambed onto the bead 12 of continuous smooth circular form, and seals with both the inner and outer diameter walls 14 and 15 thereof at the joinder of rim 13 therewith respectively.

Operation of means C shifts the piston wall and plate 25-26 toward the cover A to draw a partial vacuum simultaneously forcing the bellows 20 radially outward into pressured engagement with the inner diameter wall of the container and whereby the surrounding atmosphere pressures the bellows more tightly thereagainst to ensure hermetic engagement that maintains the pressure differential established thereby, to be broken only by a reverse operation that normalizes the interior and exterior pressures. Accordingly, the vacuum tends to draw moisture from the contained content and thereby prolongs its freshness.

Having described only a typical preferred form and application of my invention, I do not wish to be limited or restricted to the specific details herein set forth, but wish to reserve to myself any modifications or variations that may appear to those skilled in the art.

I claim:

1. A removable vacuumizing closure for the open perimeter end of a container with content remaining therein and including, a positionable diaphragm with seal means releasably engageable with the perimeter end of the container, and actuating means to releasably position the diaphragm outward from a position toward the interior of the container, whereby a partial vacuum is releasably drawn upon said content therein.

2. The vacuumizing closure for the open end container as set forth in claim 1, wherein the positionable diaphragm is made of an elastomer shaped to the perimeter end of the container and held thereto by differential pressure when the diaphragm is positioned outward from the interior of the container.

3. The vacuumizing closure for the open end container as set forth in claim 1, wherein the perimeter end of the container has an inner wall, and wherein the positionable diaphragm is made of an elastomer shaped to the perimeter end of the container and having an interference fit with said inner wall and held thereto by said vacuum.

4. The vacuumizing closure for the open end container as set forth in claim 1, wherein the perimeter end of the container has an inner wall, and wherein the positionable diaphragm is made of an elastomer shaped to the perimeter end of the container and the seal means having a continuous lip engageable with said inner wall and held thereto by said vacuum.

5. The vacuumizing closure for the open end container as set forth in claim 1, wherein the perimeter end of the container has inner and outer walls joined by a rim, and wherein the positionable diaphragm is made of an elastomer forming the seal means shaped to said inner and outer walls and rim of the container and held thereto by said vacuum.

6. The vacuumizing closure for the open end container as set forth in claim 1, wherein the perimeter end of the container has inner and outer walls joined by a rim, and wherein the positionable diaphragm is made of an elastomer forming the seal means shaped to said inner and outer walls and having a continuous lip engageable with said inner wall and held thereto by said vacuum.

7. The vacuumizing closure for the open end container as set forth in claim 1, wherein the actuating means comprises a cover fitted over the seal means and a piston releasably drawn to the cover by manually operable means.

8. The vacuumizing closure for the open end container as set forth in claim 1, wherein the actuating means comprises a cover carried upon the seal means and having a guide for a piston operable with the diaphragm and releasably drawn to the cover by manually operable means.

9. The vacuumizing closure for the open end container as set forth in claim 1, wherein the actuating means comprises a cover seated over the seal means and a piston positioned outward from said position toward the interior of the container by a manually operable lever bearing against the cover.

10. The vacuumizing closure for the open end container as set forth in claim 1, wherein the actuating means comprises a cover carried upon the seal means and having a guide for a piston rod operable with a piston portion of the diaphragm and positioned outward from said position toward the interior of the container by a lever operated cam manually shiftable in bearing engagement against the cover.

11. A removable vacuumizing closure for the open perimeter end of a container with content remaining therein substantially below said perimeter end, and including, a positionable diaphragm integral with and initially extending into the container from seal means releasably engageable with the perimeter end of the container, and actuating means to releasably position the diaphragm outward from said initial position extending into the container, whereby a partial vacuum is releasably drawn upon said content therein.

12. The vacuumizing closure for the open end container as set forth in claim 11, wherein the positionable diaphragm is made of an elastomer shaped to the perimeter end of the container and held thereto by differential pressure when the diaphragm is positioned outward from the interior of the container.

13. The vacuumizing closure for the open end container as set forth in claim 11, wherein the positionable diaphragm is made of an elastomer having a bellows extending into the container proximate to the content substantially below said perimeter end, and the seal means peripherally engaging and supported by said perimeter end of the container and held thereto by differential pressure when the diaphragm is positioned outward from the interior of the container.

14. The vacuumizing closure for the open end container as set forth in claim 11, wherein the perimeter end of the container has an inner wall and wherein the positionable diaphragm is made of an elastomer shaped to the perimeter end of the container and having an interference fit with said inner wall and held thereto by said vacuum.

15. The vacuumizing closure for the open end container as set forth in claim 11, wherein the perimeter end of the container has an inner wall, and wherein the positionable diaphragm is made of an elastomer shaped to the perimeter end of the container and the seal means having a continuous lip engageable with said inner wall and held thereto by said vacuum.

16. The vacuumizing closure for the open end container as set forth in claim 11, wherein the perimeter end of the container has inner and outer walls joined by a rim, and wherein the positionable diaphragm is made of an elastomer forming the seal means shaped to said inner and outer walls and rim of the container and held thereto by said vacuum.

17. The vacuumizing closure for the open end container as set forth in claim 11, wherein the perimeter end of the container has inner and outer walls joined by a rim, and wherein the positionable diaphragm is made of an elastomer forming the seal means shaped to said inner and outer walls and having a continuous lip engageable with said inner wall and held thereto by said vacuum.

18. The vacuumizing closure for the open end container as set forth in claim 11, wherein the actuating means comprises a cover fitted over the seal means and a piston releasably drawn to the cover by manually operable means.

19. The vacuumizing closure for the open end container as set forth in claim 11, wherein the actuating means comprises a cover carried upon the seal means and having a guide for a piston operable with the diaphragm and releasably drawn to the cover by manually operable means.

20. The vacuumizing closure for the open end container as set forth in claim 11, wherein the actuating means comprises a cover seated over the seal means and a piston positioned outward from said position toward the interior of the container by a manually operable lever bearing against the cover.

21. The vacuumizing closure for the open end container as set forth in claim 11, wherein the actuating means comprises a cover carried upon the seal means and having a guide for a piston rod operable with a piston portion of the diaphragm and positioned toward the interior of the container by a lever operated cam manually shiftable in bearing engagement against the cover.

* * * * *